US006629331B2

(12) United States Patent
Panfili et al.

(10) Patent No.: US 6,629,331 B2
(45) Date of Patent: Oct. 7, 2003

(54) ERGONOMIC HAND SCRAPER

(75) Inventors: Jean-Pierre Panfili, Berthierville (CA); François Panfili, Berthierville (CA)

(73) Assignee: A. Richard Ltée, Berthierville (CA)

( * ) Notice: Subject to any disclaimer, the term of this patent is extended or adjusted under 35 U.S.C. 154(b) by 16 days.

(21) Appl. No.: 09/766,607

(22) Filed: Jan. 23, 2001

(65) Prior Publication Data

US 2002/0095737 A1 Jul. 25, 2002

(51) Int. Cl.[7] ..... A47L 13/022; A47L 13/08

(52) U.S. Cl. ..... 15/236.06; 15/143.1; 15/236.01; 15/236.05; 30/169; 30/172; D32/48; D32/49

(58) Field of Search ..... 15/143.1, 236.01, 15/236.05, 236.06; 30/169, 172; D32/46, 48, 49

(56) References Cited

U.S. PATENT DOCUMENTS

| | | | | | |
|---|---|---|---|---|---|
| 2,517,247 | A | * | 8/1950 | Seley | 15/143.1 X |
| 3,363,316 | A | * | 1/1968 | Skarsten | 15/236.05 X |
| D305,818 | S | * | 1/1990 | Chen | D32/48 |
| 4,890,351 | A | | 1/1990 | Wilson | 15/236.01 |
| 4,955,138 | A | | 9/1990 | Henke et al. | 30/169 |
| 5,455,981 | A | | 10/1995 | Wiese | 15/236.01 |
| D368,999 | S | * | 4/1996 | Chen | D32/48 |
| D424,767 | S | * | 5/2000 | Shea | D32/48 |
| 6,216,306 | B1 | * | 4/2001 | Esterson et al. | 15/236.01 X |
| D453,251 | S | * | 1/2002 | Gringer et al. | D32/48 |

FOREIGN PATENT DOCUMENTS

| | | | | |
|---|---|---|---|---|
| FR | 1389252 | * | 1/1965 | 15/236.01 |

* cited by examiner

*Primary Examiner*—Mark Spisich
(74) *Attorney, Agent, or Firm*—ROBIC

(57) ABSTRACT

A hand scraper having a blade with a cutting edge that is attached to a handle having a rear end, a central portion and a front end with a bottom portion shaped and sized to receive and act as a support for the blade. The handle is upwardly curved over all its length in order to give room to a user's fingers below its central portion when this central portion is gripped by the fingers and the blade and the bottom portion of the rear end of the handle are in contact with a surface, and simultaneously to allow maximum transfer of pressure exerted by the user in the central section of the handle towards the blade at the front end thereof. Advantageously also, the central portion of the handle is covered at least in part with a layer of rubber material in order to maximize grip and reduce hand fatigue in use.

8 Claims, 4 Drawing Sheets

ERGONOMIC HAND SCRAPER

BACKGROUND OF THE INVENTION a) Field of the Invention

The present invention relates to a hand scraper.

More specifically, it relates to a hand scraper having an ergonomic design that gives it more powerful scraping effect in addition of making it more comfortable and safer in use.

b) Brief Description of the Prior Art

There are numerous hand scrapers presently available on the market, which basically comprise a blade extending transversely at one end of a supporting handle. Such scrapers are commonly used to remove paint or other materials from a surface.

Usually, the handle is straight and flat and the blade projects in the same plane as the handle or at an angle below the same (see, for example, U.S. Pat. Nos. 4,890,351 and 4,955,138). Alternatively, the blade can be of an inverted U-shape with a flat top attached to the handle and two bottom legs each forming a scraping edge (see item 3 in FIG. 1). Of course, in order to be efficient and the scraper must have a strong, easy-to-grasp handle, and a properly positioned, easy-to-replace blade.

SUMMARY OF THE INVENTION

A first object of the present invention is to provide a hand scraper of the above mentioned type, whose handle is upwardly curved over all its length in order to give more room to the user's fingers and to allow maximum transfer of a downward pressure exerted by the user towards the blade.

Another object of the invention is to provide a hand scraper as defined hereinabove, whose handle is rubberized in order to maximize grip and reduce hand fatigue.

A further object of the invention is to provide a hand scraper as defined hereinabove, which is provided with a transverse bead that projects downwardly from the handle close to the blade and acts as a safety guard to prevent the user's fingers from inadvertent contact with the blade, especially in the case of a blade of inverted U-shape.

The hand scraper according to the invention is of the type comprising:

a blade having at least one cutting edge;

a handle having a front end with a bottom portion shaped and sized to receive and act as a support for the blade, the handle also having a central portion and a rear end with a bottom portion; and attachment means for detachably connecting in a rigid manner the blade to the bottom portion of the front end of the handle in such a way that the handle and the cutting edge of the blade extend perpendicularly to each other.

In accordance with the invention, the hand scraper is characterized in that the handle is upwardly curved over all its length in order (1) to give room to a user's fingers below the central portion when said central portion is gripped by said fingers and the blade and the bottom portion of the rear end of the handle are in contact with a surface; and (2) to allow maximum transfer of pressure exerted by the user in the central section of the handle towards the blade at the front end thereof.

In accordance with a particularly preferred embodiment of the invention, the central portion of the handle is covered at least in part with a layer of rubber material in order to maximize grip and reduce hand fatigue in use.

In accordance with another particularly preferred embodiment of the invention, the bottom portion of the rear end of the handle is round-shaped and of a reduced size in order to reduce as much as possible friction contact with the surface in use. Moreover, the central portion of the handle has a rear part with a recessed bottom portion in order to give additional room to the user's fingers and to allow maximum pulling action in use. In addition, the front end of the handle has a top portion which is slightly recessed in a direction parallel to the edge(s) of the blade in order to form opposite reinforcing edges on both sides of the top portion of the front end of the handle and thus to allow maximum downward pressure onto the blade in use.

As aforesaid, the blade can be flat. Alternatively, the blade can have an inverted U-shape with a flat top sized to fit onto the bottom portion of the front end of the handle, and with two bottom legs each acting as said at least one edge of the blade.

In the latter case, the bottom portion of the front end of the handle preferably incorporates a transversally extending, downwardly projecting bead that is positioned to be adjacent to one of the edges of the blade after the blade has been connected to the handle. This bead acts as a locking means to prevent uncontrolled rotation of the blade relative to the handle in the case of inadvertent release of the attachment means, and as a safety guard to prevent the user's fingers for inadvertent contact with the blade.

The invention and its advantages will be better understood upon reading the following non-restrictive description of two preferred embodiments of the invention, made with reference to the accompanying drawings.

DETAILED DESCRIPTION OF TWO PREFERRED EMBODIMENTS

Figure 1:
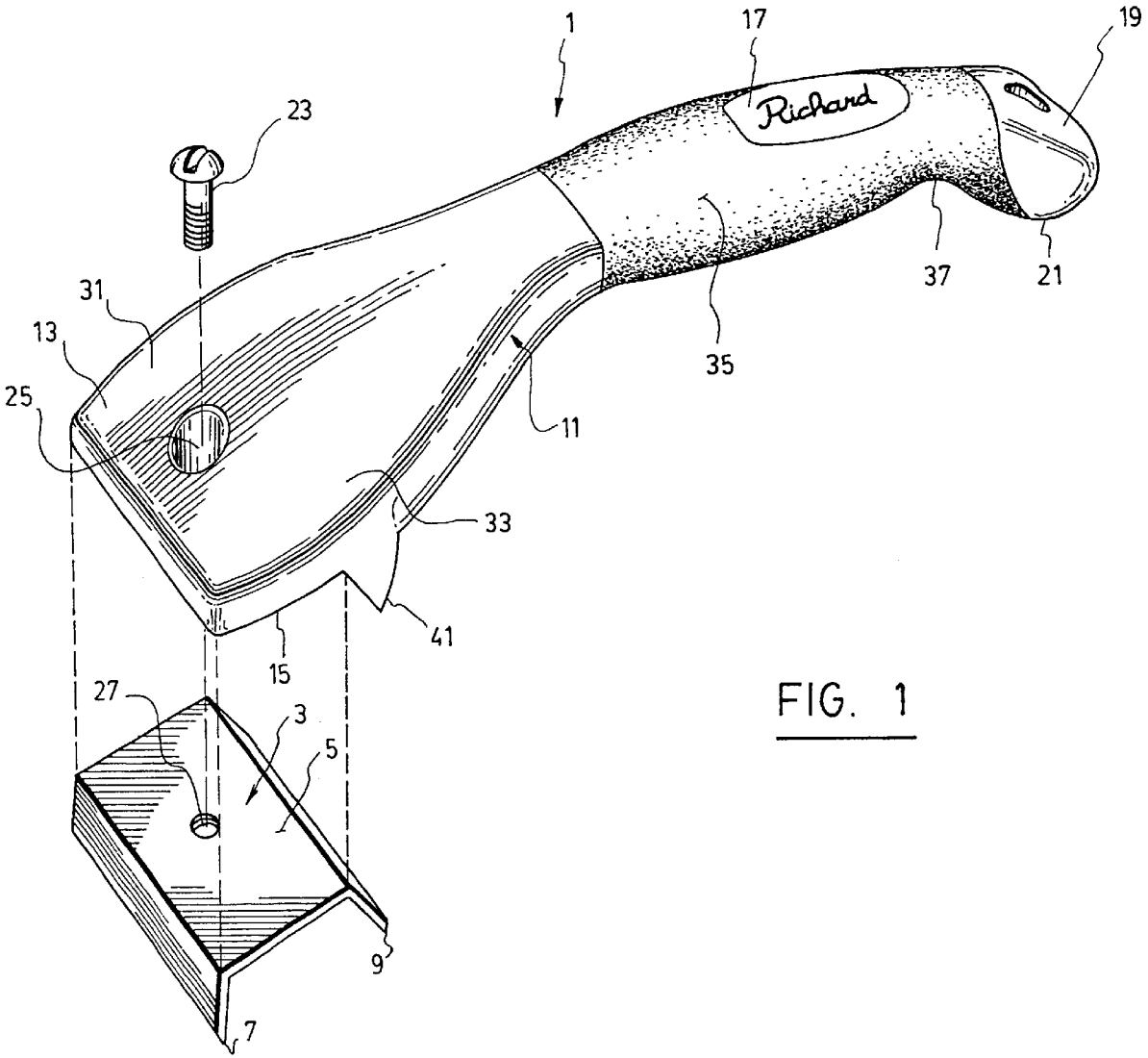
FIG. 1 is a top perspective view of a hand scraper according to a first preferred embodiment of the invention, showing the blade in spaced apart position.
Figure 3:
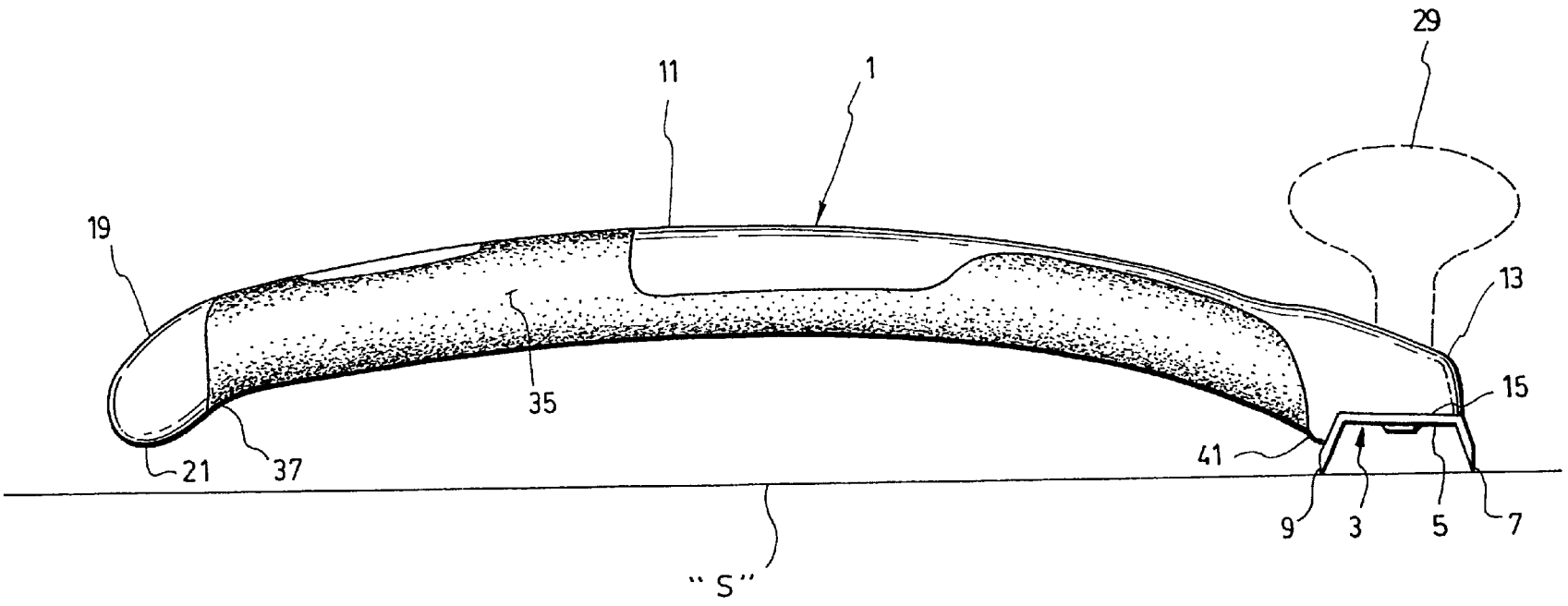
FIG. 3 is a side elevational view of a hand scraper according to a second preferred embodiment of the invention.

The hand scraper 1 according to the two preferred embodiments of the invention respectively shown in FIGS. 1 and 3 comprises a blade 3 that is preferably made of high carbon steel and has an inverted U-shape with a flat top 5 sized to fit onto the bottom portion 15 of the front end 13 of the handle 11, and with two bottom legs forming a pair of opposite scraping edges 7, 9. As is of common practice, the bottom portion 15 of the front end 13 of the handle 11 has a given width and the blade 3 has a length substantially equal to this width so as not to extend laterally outside of the front end 13 when it is connected thereto.

As aforesaid, the invention is not restricted to the use of a blade of this shape, which is known per se. As a matter of fact, it could also be used with a flat blade of conventional shape and structure, as is also of common practice in this field.

The hand scraper 1 also comprises a handle 11. This handle 11 has a front end 13 with a bottom portion 15 shaped and sized to receive and act as a support for the blade 3. The handle 11 also has a central portion 17 and a rear end 19 with a bottom portion 21.

Of course, attachment means 23 must be provided for detachably connecting in a rigid manner the blade 3 to the bottom portion 15 of the front end 13 of the handle 11 in such a way that the handle 11 and the cutting edges 7, 9 of the blade 3 extend perpendicularly to each other. As shown in FIG. 1, these attachment means may consist of a screw 23 sized to fit into a through-hole 25 provided in the front end of the handle and to be fixed into a threaded hole 27 provided into the blade 3. Alternatively, the attachment means may consist of a bolt and nut sized to fit into corresponding holes provided in the blade and the front end 13 of the handle 11. In the latter case, the nut can be part of a knob 29 that projecting upwardly on top of the front end 13 of the handle 11 after connection of the blade, as is shown in dotted lines in FIG. 3.

All of these attachment means are well known per se and need not be further described.

The two preferred embodiments disclosed hereinabove are very similar in structure. The basic difference lies in that the scraper according to the first embodiment shown in FIG. 1 has a handle 11 sized to be gripped by one hand only whereas the scraper according to the second embodiment shown in FIG. 3 has a handle 11 sized to be gripped by two hands (see FIG. 4).

In both embodiments, the handle 11 is upwardly curved and such a curvature extends over all its length. This feature is an essential element of the invention since it gives room to the user's fingers below the central portion 17 when this central portion is gripped by the fingers and the blade and the bottom portion 21 of the rear end 19 of the handle are in contact with a surface (see FIG. 4). This feature is also an essential element of the invention since it allows maximum transfer of the pressure exerted by the user in the central section 17 of the handle towards the blade 3 at the front end thereof.

In order to further improve the transfer of pressure and simultaneously reinforce the handle, the front end 13 of the handle may have a top portion which is slightly recessed in a direction parallel to the edges 7, 9 of the blade 3 in order to form opposite reinforcing edges 31,33 on both sides of the top portion of the front end and thus to allow maximum downward pressure onto the blade in use.

Advantageously, the central portion 17 of the handle 11 is ergonomically shaped and covered at least in part with a layer of rubber material 35. Such permits to maximise grip and reduce hand fatigue in sue.

Advantageously also, the bottom portion 21 of the rear end 19 of the handle is preferably round-shaped and of a reduced size. Such a feature also advantageous inasmuch as it reduces friction contact with the adjacent surface in use.

Moreover, the central portion 17 of the handle has a rear part with a recessed bottom portion 37 in order to give additional room to the user's fingers and to allow maximum pulling action in use.

Figure 2:
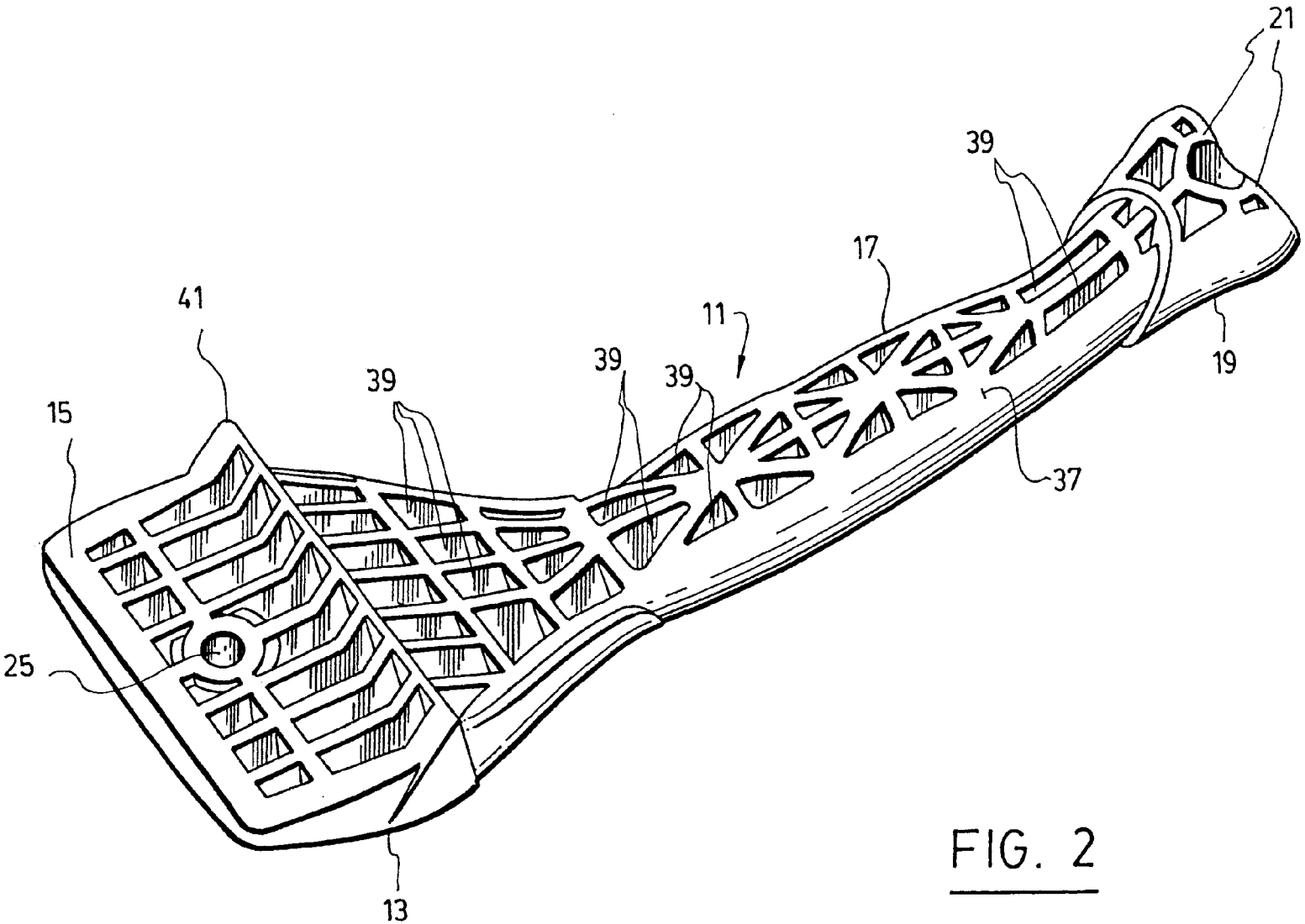
FIG. 2 is a bottom perspective view of the handle of the hand scraper shown in FIG. 1, without its layer of rubber.

Preferably, the handle 11 is made of plastic material and devised to give room to the rubber material (see the central portion 17 that is in recess). The handle 11 is also provided with holes 39 over most of its length in order to reduce its weight as much as possible (see FIG. 2). Of course, some of these holes become filled up with the rubber material 35 when the handle is completed (see again FIG. 2).

In accordance with another particularly interesting feature of the invention, the bottom portion 15 of the front end 13 of the handle 11 incorporates a transversally extending, downwardly projecting bead 41 that is positioned to be adjacent to one 9 of the edges of the blade 3 after the blade has been connected to the handle. In use, the bead 41 acts as a locking means to prevent uncontrolled rotation of the blade 3 relative to the handle 11 in the case of inadvertent release of the attachment means. It also acts as a safety guard to prevent the user's fingers from inadvertent contact with the blade.

Figure 4:
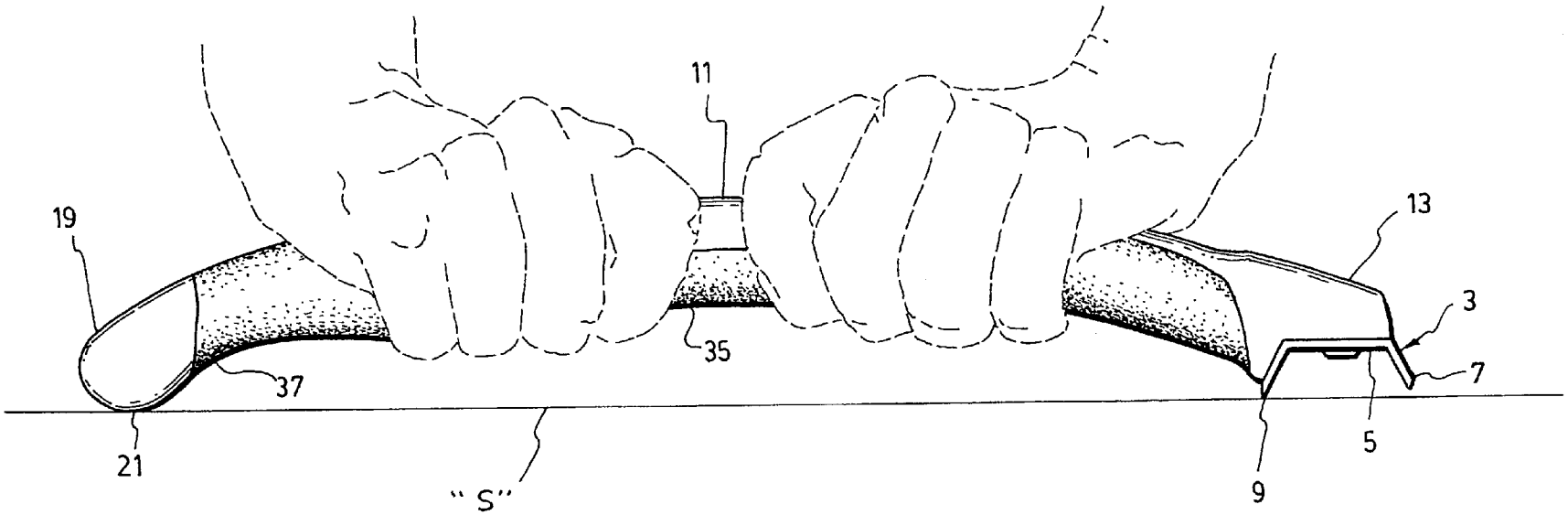
FIG. 4 is a view similar to the one shown in FIG. 3 where the handle of the scraper is held in operative position with both hands.

Preferably, as shown in FIG. 3, the handle 11 is shaped so that, when both edges 7, 9 of the blade 3 are in contact with an adjacent flat surface "S", the bottom portion 21 of its rear end 19 extends at a short distance above this flat surface (preferably half an inch). As a result, when the handle is pressed down onto the surface as is shown in FIG. 4, only the "rear" edge 9 of the blade 3 is in contact with the surface and may be used to scrap the same. As soon as the handle is slightly lifted up, the "front" edge 7 of the blade comes into contact with the surface. Such gives full reversibility to the scraper 11.

As it may now be better appreciated, the hand scraper 1 according to the invention has an ergonomic design that gives it more powerful scarping. Its rubberized handle maximized grip and reduces hand fatigue. Moreover, its front bead 41 gives a total hand protection.

Of course, minor modifications could be made to the embodiments disclosed hereinabove without departing from the scope and goals of the invention.

What is claimed is:

1. A hand scraper operable along apposite first and second directions against a surface for scraping said surface, the hand scraper comprising:

a blade having at least one cutting edge, the blade having an inverted U-shape with a flat top and with first and second bottom legs, either of said bottom legs acting as said at least one cutting edge of the blade and further acting as a first support against the surface for the hand scraper when in use, the first bottom leg being configured for scraping the surface when the hand scraper is operated along the first direction, and the second bottom leg being configured for scraping the surface when the hand scraper is operated along the second direction;

a handle having:

a front end having:

a bottom portion shaped and sized to receive and act as a support for the blade, said bottom portion having a given width and said blade having a length substantially equal to said given width so as not to extend outside of said front end when the blade is connected thereto, said bottom portion further incorporating a transversally extending, downwardly projecting bead that is positioned to be adjacent to one of the edges of the blade after said blade has been connected to the handle, said bead acting as a safety guard to prevent user's fingers from inadvertent contact with the blade; and a top portion being slightly recessed in a direction parallel to said at least one cutting edge of the blade in order to form opposite reinforcing edges on both sides of the top portion and to allow maximum downward pressure onto the blade in use;

a rear end having a bottom portion being round-shaped and acting as a second support against the surface for the hand scraper when in use, said bottom portion of the rear end of the handle being of reduced size in order to reduce as much as possible friction contact with the surface when in use; and a central portion, said central portion extending between the front and rear ends of the handle and being upwardly curved over all of its length to give room to user's fingers below the central portion when said central portion is gripped by said fingers and when one of the legs and the bottom portion of the rear end of the handle are in contact with the surface during use of the hand scraper, the central portion of the handle being covered at least in part with a layer of rubber material in order to maximize grip and reduce fatigue of users fingers, the central portion of the handle further having a rear part with a recessed bottom portion in order to give additional room to users fingers and to allow them maximum pulling action in use;

attachment means for detachably connecting in a rigid manner the blade to the bottom portion of the front end of the handle in such a way that the handle and said at least one cutting edge extend perpendicularly to each other.

2. The hand scraper of claim 1, wherein the handle is made of plastic material and is provided with holes over most of its length in order to reduce its weight as much as possible.

3. The hand scraper of claim 2, wherein the handle is sized to be gripped by one hand only.

4. The hand scraper of claim 3, wherein the attachment means consists of a bolt and nut sized to fit into corresponding holes provided in the blade and the front end of the handle.

5. The hand scraper of claim 2, wherein the handle is sized to be gripped by two hands.

6. The hand scraper of claim 5, wherein the attachment means consists of a bolt and nut sized to fit into corresponding holes provided in the blade and the front end of the handle.

7. The hand scraper of claim 2, wherein the attachment means consists of a bolt and nut sized to fit into corresponding holes provided in the blade and the front end of the handle.

8. The hand scraper of claim 7, wherein the nut is part of a knob projecting upwardly on top of the front end of the handle after connection of the blade.

* * * * *